United States Patent [19]

Haberl

[11] Patent Number: 4,490,876

[45] Date of Patent: Jan. 1, 1985

[54] FLUE CLEANING DEVICE

[76] Inventor: Jeffrey S. Haberl, 350 27th St., Boulder, Colo. 80303

[21] Appl. No.: 519,013

[22] Filed: Aug. 1, 1983

[51] Int. Cl.[3] ..... F23J 3/02

[52] U.S. Cl. ..... 15/163; 126/16

[58] Field of Search ..... 15/162, 163, 242, 249, 15/104.2, 104.05; 126/16

[56] References Cited

U.S. PATENT DOCUMENTS 1,362,660 12/1920 Zave ..... 15/249

4,071,919 2/1978 Fields et al. ..... 15/163 X

FOREIGN PATENT DOCUMENTS 78479 12/1894 Fed. Rep. of Germany ..... 15/163

476572 12/1952 Italy ..... 15/162

*Primary Examiner*—Peter Feldman

*Attorney, Agent, or Firm*—Klaas & Law

[57] ABSTRACT

A flue cleaning device for cleaning the interior cavity of a flue of the type used with a wood burning stove or the like. The device comprises a laterally extending tubular member in fluid communication with the flue, a slideable chute is mounted in the tubular member which is moveable into interfering relationship with the flue cavity to receive the combustion product debris scraped from the flue walls during a cleaning operation. A cleaning brush mounted on a cable and suspended from a pulley in an upper portion of the flue permits the brush to be moveable up and down the flue as well as being retained when desired within the laterally extending tubular member. The brush is moved by a winding device mounted within the laterally extending tubular member and operable from outside the tubular member. Discharge apparatus for receiving combustion materials and chute movement apparatus are also described.

14 Claims, 13 Drawing Figures

FLUE CLEANING DEVICE

BACKGROUND OF THE INVENTION

The present invention relates generally to cleaning devices for flues of wood stoves or the like and more particularly to an apparatus and method for cleaning a flue which allows a flue to be cleaned by the manipulation of a device provided at a lower end of the flue that provides for actuation of flue cleaning devices without removal of flue pipe sections or insertion of apparatus into the flue through the chimney.

The cleaning of flues associated with heating systems such as wood burning stoves and coal burning stoves is necessary and often required for safety reasons but in the past has been inconvenient and time consuming due to the fact that the only orifice in which to insert a cleaning device is the top of the chimney which is often accessible only from the roof. Cleaning of such flues has generally been performed by a person standing on the roof of the building containing the flue who inserts a cleaning brush down the flue through the chimney opening. One problem with this type of cleaning operation is in the collection of dirty and often combustible material which is scraped loose in the cleaning process. This loose material may fall into the stove to which the flue is connected or may fall and becomes lodged in a curved horizontal portion of the flue. In either case, removal of the soot and combustible creosote type material from these areas is difficult and often results in spilling of the material in the area around the stove.

It would be generally desireable to provide a flue cleaning device which would allow a person standing near the lower end of the flue to clean the flue and remove flue combustion product debris in a clean and convenient operation. This has been impossible in the past due to the conventional construction of dampers in the lower end of the flue.

SUMMARY OF THE INVENTION

The present invention is a flue cleaning device for cleaning the interior cavity of a vertically extending flue of the type which is used with wood burning stoves and the like. The device comprises a laterally extending orifice means projecting outwardly from a lower portion of the flue, above the damper, which is used to retain or store a flue cleaning brush and which also houses a brush movement means disclosed here as a winding device which may be used to move the brush into the flue and up and down along the length of the flue to scrape free combustion product material. The laterally extending orifice means may comprise an inverted "Y" configuration having a flue accepting longitudinally extending tubular portion mounted generally in coaxial alignment with the flue and having a tubular laterally extending portion attached in sealed relationship with the longitudinally extending portion for providing access into the flue from the lateral chamber. A chute means for accepting and deflecting flue discharge material can be slideably mounted within the lateral cavity and may be moved into the flue to accept and divert the flue discharge material during cleaning and then moved out of the flue to allow free passage of combustion gases when the cleaning device is not in use. The flue cleaning brush in the preferred embodiment is attached to two cable strands or chains, one of which is suspended from a pulley at the top of the flue. The cable strands are reverse wound about adjacent portions of a double drum pulley which permits the brush to be moved or advanced upwardly through the flue when a crank arm attached to the double drum pulley is turned in one direction and moved downwardly through the flue and back into the lateral chamber when the crank arm is rotated in the opposite direction. Since the brush is attached to both strands of cable, it is possible to remove the brush from the flue and reattach it to a new cable without disassembling the flue even if one of the cable strands were to break. If the strand suspended from the pulley were to break, the brush could be retracted into the lateral chamber by winding up the remaining strand. If the cable strand which is not suspended from the pulley were to break, the brush could be advanced to the suspension point at the top of the flue, where it could be readily removed, by winding up the suspended cable. Thus a fail safe system for brush removal is provided by the double strand cable system. The entire winding apparatus is positioned within the lateral chamber with only the crank arm protruding in a sealed relationship therefrom to prevent smoke from exhausting. The chute is moved in and out of the flue cavity by means of an arm mounted on the surface of the chute which extends through a slot in the laterally extending tubular member. A discharge orifice is provided at a lower portion of the laterally extending tubular member which is connectable to a trash bag or the like for receiving flue material which is scraped free by the brush and deflected by the chute into the laterally extending tubular member.

In operation, the chute is extended into wall engaging contact with the interior cavity of the flue. Next, the brush is moved through the lateral cavity into the flue and then up and down within the flue to remove residual combustion material that normally builds up on the flue interior surface. A spring is swivelly mounted between the pulley, on which the brush cable is mounted, and a bracket at the top of the flue to limit the amount of force which can be applied on the brush and to take up or allow tensioning slack in the cable during those periods when the brush moves around a corner. A winding, limiting device or signal device may also be provided to prevent a person using the cleaning device from moving the brush too far in either direction. When the cleaning operation is completed, the brush is then moved back into the lateral cavity. The chute is also withdrawn into the lateral cavity thereby allowing free flow of combustion gases through the flue, for normal operation as a chimney.

BRIEF DESCRIPTION OF THE DRAWING

An illustrative and presently preferred embodiment of the invention is shown in the accompanying drawing in which.

DETAILED DESCRIPTION OF THE INVENTION

Figures 1, 2:
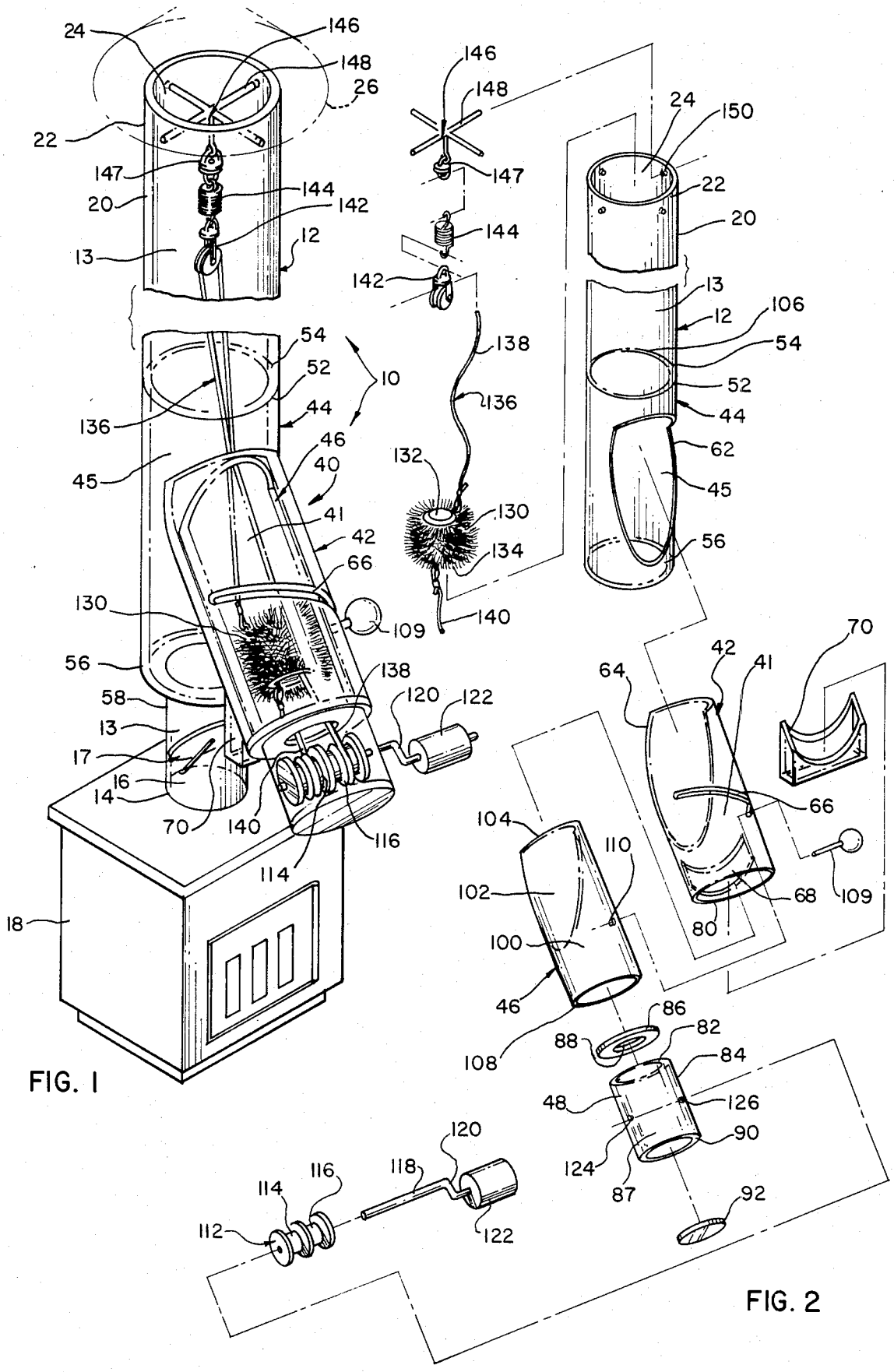
FIG. 1 is a transparent perspective view of a wood stove flue and flue cleaning device mounted thereon.
FIG. 2 is an exploded transparent perspective view of a flue and the flue cleaning device of the present invention.
Figure 13:
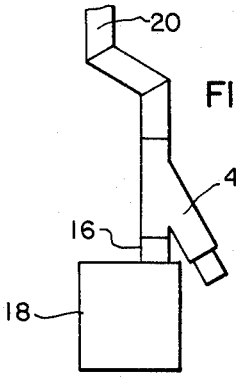
FIG. 13 is an elevation view of the flue cleaning device of the present invention used with a flue having a bending upper flue section.

As illustrated by FIGS. 1 and 2, one embodiment of the flue cleaning device 10, of the present invention, is used in association with a vertically extending flue 12 having a flue cavity 13. The flue may be provided in sections and may have a flue stove connector portion 16 which is attached at its lower end 14 to a wood stove 18 or the like. The flue damper 17 may be provided below the flue cleaning device 10. The flue may have an upper section 20 having an upper end portion 22 with an upper flue opening 24 therein which provides an exhaust outlet which may have a chimney cover 26 mounted above it or which may be connected to other flue portions (not shown) which are in turn connected to a chimney outlet. The upper section 20 may be a straight section as illustrated in FIGS. 1 and 2 or may be a bending section as illustrated in FIG. 13. A laterally extending orifice means 40 having a lateral cavity 41 is provided in a convenient location by means of a laterally extending outer tubular member 42 which is sealingly connected, as by welding, in fluid communication with a longitudinally extending flue coupling member 44. In the preferred embodiment the laterally extending orifice means 40 comprises the laterally extending outer tubular member 42 and longitudinally extending flue coupling member 44 connected in an inverted Y configuration. The longitudinally extending flue coupling member 44 may be sealingly attached in coaxial alignment with flue upper section 20 and flue lower section 16. In this arrangement, the internal cavity 45 of the flue coupling member 44 comprises a portion of the flue cavity 13. This configuration of the lateral extending orifice means 40 allows the flue cleaning device to be conveniently connected to a flue by merely replacing a longitudinal section of the flue above any existing damper. The present invention could also be practiced by simply sealably mounting the laterally extending tubular member on the outer wall of a any continuous flue in a manner similar to that in which it is mounted to tubular member 44. A rectangular shaped flue, such as a conventional masonary flue, would employ a rectangular shaped brush and a rectangular cross-sectioned laterally extending tubular member.

A chute member 46 is slideably mounted within laterally extending tubular member 42. A tubular end member 48 which may comprise a continuation of laterally extending tubular member 42 is sealably attached to the lower end thereof as discussed in further detail below. The upper end 52 of coupling member 44 has substantially the same diameter as the lower end 54 of upper flue section 20 and may be sealably attached thereto by conventional attachment means well known in the art such as male and female end connections, sealing rings or the like to provide a connection which will not pass smoke under the back pressures normally encountered in use. The coupling member lower end 56 is similarly conventionally attached to lower flue section upper end 58. A cut-out portion 62 is provided in the lateral wall of coupling member 44 providing and opening into the inner cavity 45 thereof. The upper end 64 of laterally extending tubular member 42 is cut in a configuration to sealingly or sealably abut the outer periphery of cut-out section 62 to provide peripherally sealed fluid communication between cavity 45 and lateral cavity 41. The sealed connection may be through conventional sealing means such as welding or the like. A spiral slot 66 is provided on the upper surface of member 42 to provide a guide path for movement of chute member 46 as described in further detail hereinafter. A discharge means is provided at the lower lateral surface at the lower end of tubular member 42 by arcuate slot 68 which may be conventionally coupled to a downwardly extending discharge member 70. Discharge member 70 may in turn have a bag 72 or other receiving means attached at the lower end thereof as illustrated in FIGS. 3–12. The lower end 80 of tubular member 42 is attached to the upper end 82 of tubular end member 48 and may be provided with a radially extending wall portion 86 for preventing discharge material from entering the cavity 87 of tubular member 48. Wall member 86 is provided with a circular hole 88 for allowing passage of cable means 136 therethrough as discussed in further detail hereinafter. The lower end 90 of tubular member 48 is provided with a lower removeable end cap 92 which prevents exhaust of combustion gases therethrough and also facilitates removal of any flue discharge material which may enter cavity 87.

As illustrated by FIG. 2, chute member 46 comprises a chute cavity portion 100 and a chute open portion 102. The upper edge surface 104 which defines the open portion 102 is cut in a configuration which abuts the flue inner surface 106 when the chute member is extended allowing combustion material to fall into the open portion 102 and then move laterally downwardly through the cavity portion 100. Chute lower edge surface 108 may be circular in cross-section and may abut wall 86 when the chute is in the retracted position. The length of the chute 46 and the length of the tubular member 42 are such that when the chute is in a raised position extending in touching engagement with the flue wall 106 the lower end of the chute 108 is positioned at a point forward of arcuate discharge opening 68 in member 42 whereby discharge material passing through the chute passes onto the surface of member 42 and thus out the discharge opening 68 and in turn out discharge member 70, and into discharge collection bag 72. A radially extending handle 109 may be mounted, such as by a handle receiving hole 110 and weldment or other conventional attachment means, on the surface of chute 46 at a position opposite the chute cavity portion 100 on the opposite side of the chute from the open portion 102. The handle 109 extends outwardly through the spiral slot 66 and allows a person manipulating the device 10 to move the chute inwardly and outwardly of the flue cavity 13 while simultaneously revolving the chute 46 about its central longitudinal axis. This arrangement serves two separate purposes, it allows the outer surface of the chute 46 to engage the inner surface of the lateral extending outer tubular member 42 to provide a seal preventing discharge of combustion gases into the room through the discharge opening 68 used to collect the debris when the chute is in the lowered position. It also prevents the chute from jamming by allowing rotational movement of the chute in combination with its linear movement.

A winding means such as a double drum pulley 112, having a first drum portion 114 and second drum portion 116 is secured to a pulley axle 118 mounted as by holes 124, 126 within tubular end member 48. Pulley axle 118 may be provided with a crank arm 120 and crank arm handle 122 or other rotation means which are positioned outwardly of the tubular member 48 allowing a person standing near the flue to rotate the drum 112. A brush means such as cylindrical wire brush 130 having a outer diameter substantially identical to or slightly larger than the inner diameter of flue cavity 13 is connected to a brush movement means such as cable means 136. A first strand of the cable 138 is attached to the brush upper end 132 and a second of the cable 140 is attached to the brush lower end 134. The first strand 138 of the cable is suspended from an upper portion of the flue as by a pulley 142 which may be mounted by a spring 144 which is in turn attached to a bracket 146 by a swivel arrangement 147. The bracket is of a type designed to minimumly interfere with the passage of flue gases and may comprise bracket arms 148 attached to bracket holes 150 in the upper portion of the flue 12. The first cable strand 138 is wound about one drum portion 116 and the second strand 140 is wound about the other drum portion 114 in a reverse direction to the first strand. This arrangement allows the brush to be moved in one direction by rotation of the double drum pulley 112 in one direction and allows movement of the brush in the opposite direction by rotation of the double drum pulley in the opposite direction. The swivel mounting 117 of the spring 144 allows the cable to be variably angularly displaced within the flue and the spring 144 limits the tension which may be exerted on the cable during winding. This tension limiting feature facilitates movement of the brush around bends and corners. Thus the brush may be moved through the chute 46 and a laterally extending tubular member 42 and upward and downward within the flue cavity 13 to dislodge condensed combustion products from the inner flue wall 106.

Figure 3:
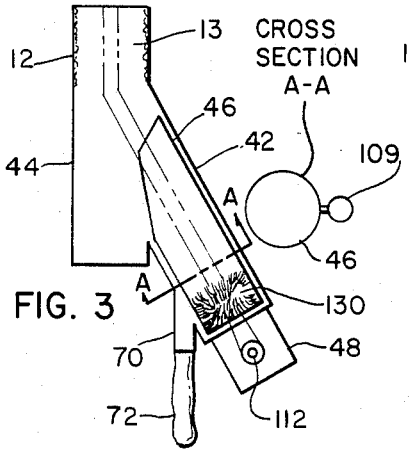
FIGS. 3–12 are schematic cross sectional elevation views illustrating use of the flue cleaning device of the present invention.
Figure 6:
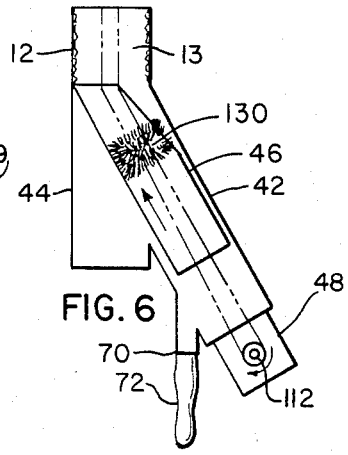
Figure 10:
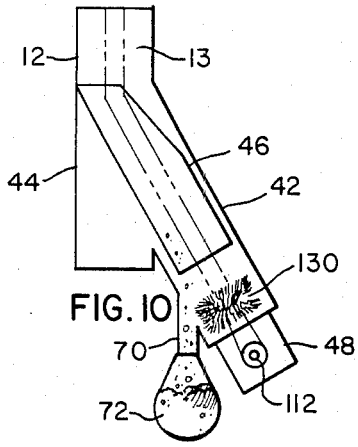
Figure 4:
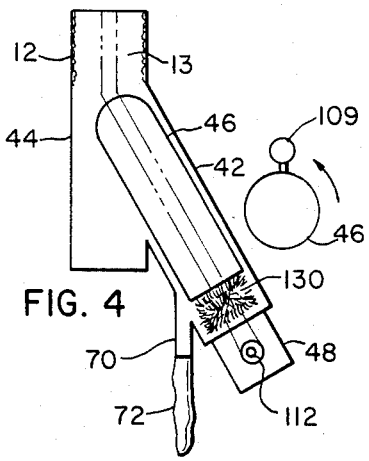
Figure 7:
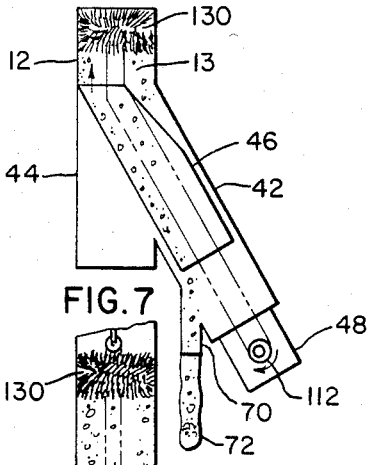
Figure 11:
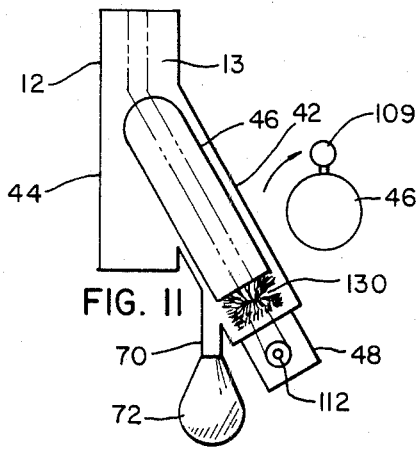
Figure 5:
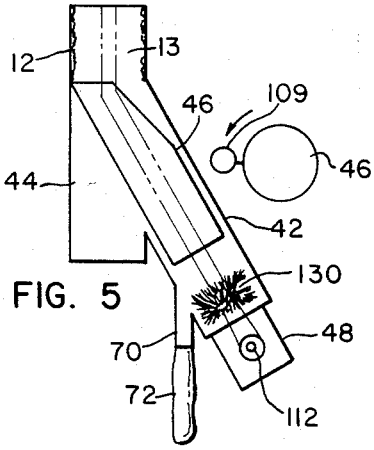
Figure 8:
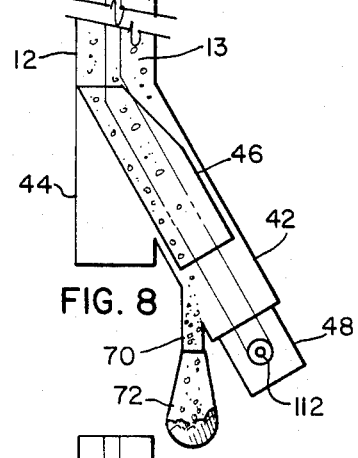
Figure 12:
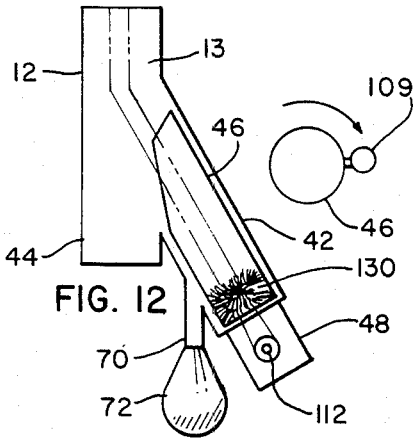
Figure 9:
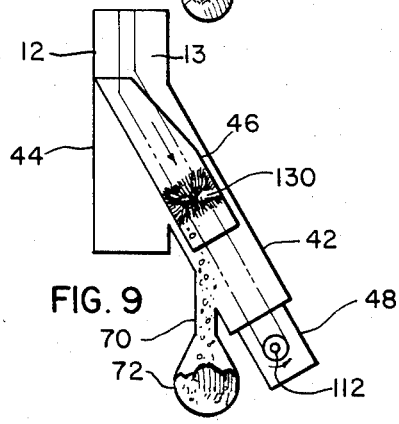

The operation of the flue cleaning device 10 is illustrated in FIGS. 3–12. As illustrated by FIG. 3, the device has an initial position in which the chute 46 is in non-interferring relationship with the flue cavity 13 and wherein the brush 130 is in a stowed position in a lower portion of the lateral tubular member 42. As illustrated by FIGS. 4 and 5 chute handle 109 is rotated in a counter-clockwise direction through an angle of substantially 180° thereby moving the chute to a raised position in engaging contact with the inner wall 106 of the flue 44. The brush 130 is then moved upwardly, by rotation of drum pulley 112, through the lateral member 42 and chute 46 as illustrated by FIG. 6. The brush upon entering the flue is moveable between a lowered position illustrated generally by FIG. 7 and an upper position illustrated by FIG. 8. Movement between these two positions causes removal of flue combustion material which is deflected laterally and downwardly by chute 46 and tubular member 42 into discharge means 68, 70, 72. After cleaning is completed the brush may be moved back into the lower portion of the lateral tubular member 42 as illustrated by FIGS. 9 and 10. The chute is thereafter moved downwardly into non-interferring relationship with the flue cavity by clockwise movement thereof from the position illustrated in FIG. 5 through the positions illustrated in FIGS. 11 and 12 into the original position. The residual combustion material receiving bag 72 is thereafter removed and conveniently disposed of. A new bag may then be fitted over a discharge coupling 70 during the next cleaning application, or other closure means, such as an end cap or the like, (not shown) may be conventionally provided. With this arrangement no combustible material, i.e. bag 70, is near the flue during operation of the wood stove.

The preferred embodiment described is but one specific apparatus which could be constructed to accomplish the results described. Utilizing the inverted "Y" structure equivalent apparatus could be provided for advancing the chimney cleaning brush up and down a flue as described herein.

It is contemplated that the inventive concepts herein described may be variously otherwise embodied and it is intended that the appended claims be construed to include alternative embodiments of the invention except insofar as limited by the prior art.

What is claimed is:

1. A flue cleaning device for cleaning the interior cavity of a vertically extending flue of the type which is used with a wood burning stove or the like comprising:

brush means for dislodging the residual products of combustion which is movable between a first position in a lower portion of the flue cavity and a second position within an upper portion of the flue cavity and capable of being stored in a third position in noninterfering relationship with the flue cavity;

laterally extending orifice means for storing said brush means in said third position for providing access to the interior cavity of the flue; and brush movement means for selectively moving said brush means between said three brush positions;

wherein said laterally extending orifice means comprises:

tubular access means for providing sealed access to the interior of the flue having a first end portion attached in sealed fluid communication with the flue at a lower portion of the flue; and chute means movably mounted in said tubular access means for directing dislodged combustion products from the flue into said first tubular means.

2. The invention of claim 1 further comprising discharge means in said tubular access means for discharging dislodged combustion products received from said chute means.

3. The invention of claim 2 wherein said discharge means comprises:

discharge orifice means positioned on a lower lateral surface portion of said tubular access means.

4. The invention of claim 3 wherein said tubular means access comprises an inverted Y-shaped configuration wherein said first end portion of said tubular access means comprises a flue accepting longitudinally extending coupling portion mounted in coaxial alignment with the flue and positioned in angled relationship with a laterally extending portion of said tubular access means.

5. The invention of claim 4 wherein said chute means is mounted in longitudinal alignment with said laterally extending portion of said tubular access means, and wherein said chute means is movable between a first position in interfering relationship with the cavity of the flue for preventing combustion products dislodged by said brush means from falling to the bottom of the flue by deflecting the dislodged combustion products into said laterally extending portion of said tubular access means; and a second position in noninterfering relationship with the cavity of the flue for allowing free passage of combustion gases through the flue when the flue is not being cleaned.

6. The invention of claim 5 further comprising chute advancing and rotating means for rotating said chute means about its central longitudinal axis and simultaneously linearly moving said chute means between said first and second chute positions.

7. The invention of claim 6 wherein said chute advancing and rotating means comprises:

spiral slot means provided in the cylindrical upper surface of said laterally extending portion of said tubular access means for directing movement of said chute means; and radially extending handle means mounted on a lower exterior surface of said chute means and received in said spiral slot means for moving said chute along said slot means;

whereby said chute means rotates as it moves linearly between said first position and said second position for preventing jamming of said chute means within said first tubular means, and wherein said low exterior surface of said chute means sealingly covers said slot means, when said chute means is in said second position whereby flue gases are prevented from being exhausted externally of the flue cleaning device.

8. The invention of claim 7 wherein said chute means comprises a terminal end portion having a shape adapted to mate with an inner curving wall surface of the flue when said chute means is in said first position.

9. The invention of claim 1 wherein said brush movement means comprises:

cable means fixedly attached to said brush means for pulling said brush in a first cable direction and in a second cable direction opposite said first cable direction;

cable suspension means positioned in the flue above said first brush position for suspending said cable means therefrom.

10. The invention of claim 9 wherein said cable movement means further comprises winding means positioned laterally outwardly of said third brush position in said laterally extending orifice means.

11. The invention of claim 10 wherein said cable means comprises a first cable end and a second cable end and wherein said winding means comprises a double drum pulley means having said first cable end wound about a first drum portion thereof and having said second cable end wound about a second drum portion thereof in the direction opposite said first end winding whereby rotation of said winding means in a first direction causes movement of said brush means in said first cable direction and rotation of said winding means in a second direction opposite said first direction causes movement of said brush means in said second cable direction.

12. The invention of claim 9 wherein said cable suspension means comprises:

a bracket member mounted in the flue; and pulley means for providing low frictional movement of the cable means therethrough.

13. The invention of claim 12 wherein said cable suspension means further comprises swivelable spring means mounted between said bracket member and said pulley means for providing variable angular positioning of said cable means within said flue and for limiting the force applied to said brush means produced by the rotation of said winding means for facilitating movement of said brush means around corners.

14. The invention of claim 12 wherein said cable suspension means is mounted proximate said second brush position and wherein said second brush position is substantially at the top of the flue cavity whereby said brush means is movable to a position for facilitating removal of said brush means from the flue cavity without disassembly of the flue by rotation of said winding means in either said first winding direction or said second winding direction whereby said brush means is readily removable from the flue cavity if one of said cable ends should fail by winding of the other of said cable ends about an associated drum portion of said double drum pulley until said brush is moved to said second brush position on said third brush position.

* * * * *